United States Patent [19]

Stadigh

[11] 4,009,767

[45] Mar. 1, 1977

[54] MAGNETICALLY ACTUATED LOCKING SYSTEM FOR ELEVATOR DOORS

[75] Inventor: Hans-Göran Stadigh, Undersaker, Sweden

[73] Assignee: Linden-Alimak AB, Skelleftea, Sweden

[22] Filed: Sept. 12, 1975

[21] Appl. No.: 612,874

Related U.S. Application Data

[63] Continuation of Ser. No. 449,154, March 7, 1974, abandoned.

[52] U.S. Cl. ..... 187/31; 187/48; 187/50; 187/61

[51] Int. Cl.² ..... B66B 1/00; B66B 13/18

[58] Field of Search ..... 187/28, 29 R, 30, 31, 187/46, 47, 48, 49, 50, 61; 200/61.62; 335/205, 206, 207

[56] References Cited

UNITED STATES PATENTS

| | | | |
|---|---|---|---|
| 1,344,430 | 6/1920 | Wigmore et al. | 187/31 X |
| 1,510,878 | 10/1924 | Wigmore | 187/31 |
| 1,531,428 | 3/1925 | Way | 187/31 |
| 1,709,970 | 4/1929 | Brubaker | 187/31 |
| 1,828,316 | 10/1931 | Chapin | 187/31 |
| 1,920,369 | 8/1933 | Ellis | 187/31 X |
| 1,955,303 | 4/1934 | Lewis | 187/31 X |
| 2,378,218 | 6/1945 | Hard | 187/31 |
| 2,598,214 | 5/1952 | Borden | 187/29 R X |
| 2,843,697 | 7/1958 | Beck | 335/207 |
| 2,989,148 | 6/1961 | Moser | 187/48 |
| 3,012,116 | 12/1961 | Boylan et al. | 335/205 |
| 3,164,696 | 1/1965 | Pusch | 335/207 X |
| 3,200,905 | 8/1965 | Holdridge | 187/61 X |
| 3,302,588 | 2/1967 | Bennett | 335/205 X |
| 3,332,516 | 7/1967 | Reinke | 187/61 |
| 3,516,034 | 6/1970 | Yamada et al. | 335/2 |
| 3,625,312 | 12/1971 | Hutner | 187/61 X |

FOREIGN PATENTS OR APPLICATIONS

| | | | |
|---|---|---|---|
| 510,430 | 12/1920 | France | 187/61 |

*Primary Examiner*—Evon C. Blunk
*Assistant Examiner*—James L. Rowland
*Attorney, Agent, or Firm*—Pollock, Vande Sande & Priddy

[57] ABSTRACT

This invention relates to a device for use in elevators for the unlocking and locking of closed doors, gates, bars or wickets. The device comprises a mechanical locking means arranged at the door, gate, bar or wicket and includes a locking bolt moved to locking position by a spring. The locking bolt is movable against the action of the spring to a non-locking position by means of an electromagnet which is arranged to be activated, by a lock actuator device carried by the elevator cage, when the cage is at a holding floor at which it is to be stopped. The locking means further includes an electrically conductive element, preferably in form of a contact washer around the locking bolt or a prolongation of the bolt, which element follows the motion of the locking bolt and operates to close an electric circuit when the bolt is in locking position. The circuit must be closed in order that the elevator can be moved from the holding floor, whereby an electrically controlled separately operable locking function is also achieved.

7 Claims, 7 Drawing Figures

MAGNETICALLY ACTUATED LOCKING SYSTEM FOR ELEVATOR DOORS

CROSS REFERENCE TO RELATED APPLICATION

Figure 1:
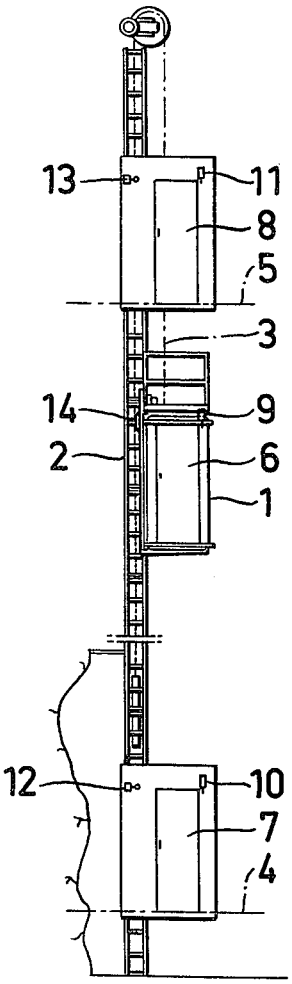

This is a continuation of application Ser. No. 449,154 filed Mar. 7, 1974 now abandoned.

This invention relates to a device for use on elevators for the mechanical unlocking and locking of closed elevator doors, gates, bars or wickets (hereinafter referred to generally as "doors"), the device comprising a locking means arranged at the door, and including a locking bolt which is moved to locking position by a spring.

The term "elevator" is intended to mean a device for guided vertical or dip transports between predetermined levels (holding floors) by means of a guided, power-driven load plane.

As the load in an elevator is, as a rule, applied by persons and may per se constitute persons (cf. passenger elevators), it is generally required that measures be taken to prevent passengers from being injured by the movable parts of the elevator equipment in normal use.

With respect to the purpose of use of the elevator set-up, its location and its technical construction, the responsible authorities all over the world have established different security levels in the form of differentiated security rules for elevators, it being understood that a higher security level as a rule causes a higher price of the elevator installation. Concurrently with the technical development of elevators, according to which the elevator speed and consequently the transport capacity of the elevator installation tend to increase, and where different problem complexes are solved in an increasingly cheap way, the technical security level is raised.

It is apparent from the above that high speed elevators for passengers and open to the public make the greatest demands for security, and only the costs of security limit their applicability for other types of elevators.

For elevators open to the public it is necessary to surround, as a first measure, the whole set-up with walls, bottom and roof (hoist shaft) and to provide the resulting openings with doors at the holding floors.

By also providing the load plane with walls and roof (to produce an elevator cage) the direct contact of using persons with the elevator set-up is reduced to comprise an elevator cage with entrance openings and holding floors with the same.

For elevators not to be used by the public, e.g., elevators for industrial purposes, building elevators, etc., the above-mentioned first measure can be limited to such places of the relative set-up, where any form of passenger traffic can occur, which is always the case at the holding floors. This also applies to material elevators, where the load is manually applied.

In order to prevent personal injuries at the openings of the holding floors all types of elevators are provided with openable means, e.g., doors, gates, bars, etc., where the purely mechanical design of the device as well as the design of the relative locking means derive from the prerequisite conditions mentioned above. A device locking mechanically, electrically or both the openable means of the openings of the holding floors is here intended by the term locking means. For the sake of simplicity these openable means have below somewhat erroneously merely been called shaft doors. Here the logical conditions can be laid down regarding when a shaft door of an elevator can be opened in normal use with a maximum of security for using persons, in the following way:

A. A shaft door may be opened only provided the elevator cage (i.e. the load plane) is at the holding floor, where it is intended to be stopped or is stopped.

B. An elevator may be started or kept in motion only if all shaft doors are in completely closed position and all shaft doors are made so that they cannot be opened.

Every manufacturer of elevators with responsibility for those using the elevators aims at satisfying the logical conditions indicated above as much as possible, by using more and more secure locking systems with the relative locking means for the shaft doors of the elevator.

The logical conditions mentioned above also relate to the openable devices of the elevator cage (load plane), where such are present, e.g., elevators, where a so-called plain hoist shaft is lacking, high-speed elevators, etc. At present only high-speed elevators satisfy these conditions, as the present systems are very expensive and therefore cannot be used in other cases than when the security demands of the authorities make them absolutely necessary.

In previously known locking devices a movable locking path member mounted on the elevator cage has been used, which member can be moved outwardly towards the walls of the hoist shaft when it is desired to open a door lock, to actuate directly mechanically a lever of the door lock, which opens the door lock when being inserted, when the elevator is being braked or has stopped at the holding floor where it is to be stopped. As a rule elevators provided with cage gates or the like have no mechanical locking to keep the elevator doors locked at a moving lift, as a conventional locking with a locking path member would be too expensive.

All these previous devices have the disadvantage that a careful mechanical adjustment is required between door lock and the movable locking path member.

The disadvantages mentioned above are removed by means of the device of the invention characterized in that the locking bolt is movable against the action of the spring to a non-locking position under the influence of an electromagnetic means actuated by an electric circuit, which electromagnetic means is arranged to be activated by means of a lock actuator device carried by the load plane (or elevator cage) when the load plane is at a holding floor at which it is to be stopped, and is further characterized by an arrangement wherein the locking means includes an electrically conductive element which follows the motion of the locking bolt, the conductive element being adapted to close an electric circuit when the bolt is in locking position, which circuit must be closed in order that the elevator can be moved from the holding floor. In this way a locking that is electrically controlled and mechanically operated, is obtained.

By means of the invention, careful mechanical adjustment between locking elements carried by the cage and cooperating locking elements carried by the shaft doors will be eliminated to a large extent while nevertheless maintaining rigorous security demands (the device of the invention satisfies in all respects the requirements according to security rules for elevators in Sweden in view of what is stated there about locks of shaft doors as well as those of cage doors), and the installation work of the elevator is accordingly substantially simplified. In case of using a locking path member and contacts operated by the locking path member, a certain adjustment between these means is required, but their location is not dependent on the location of the door and the cooperating elements can be positioned where the adjustment can be effected most easily, e.g., near the guides.

One way of making the adjustment still more independent of a close adjustment between details applied to the elevator cage and the details belonging to the lock of the shaft door is obtained according to an embodiment of the invention by having a lock actuator device carried by the elevator cage to touch free operate a door locking contact which activates an electric circuit of the locking means of the respective holding floor, when the elevator cage is at a holding floor, at which it is intended to stop. The lock actuator device on the elevator cage can, for instance, emit a directed, strong magnetic field, which operates a reed switch, which is closed by the emitted magnetic field, or else the magnetic field can operate a magnetic field controlled semi-conductor element or the like. The lock actuator device can also comprise a light source actuating a switch included in the door locking means and actuated by light. Also other types of emitter and receiver means are, of course, possible.

When the elevator cage door is also to be provided with a gate this should be kept locked by a locking means of the same type as those at the holding floors, the locking means of the elevator cage preferably being unlockable by means of an electric circuit, which is activated when the elevator cage is at a holding floor, where it is to be stopped. The electromagnetic means of the elevator cage has also a security contact, which is connected in series with the security contact of the holding floors or operates a contact in series with the security contacts of the holding floors. In this way it is assured that the elevator cannot be started from a holding floor, if all the shaft doors and the cage door of the elevator cage are not completely closed to a locked position.

Figure 5:
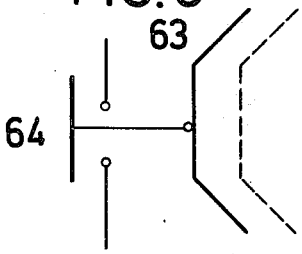
Figure 6:
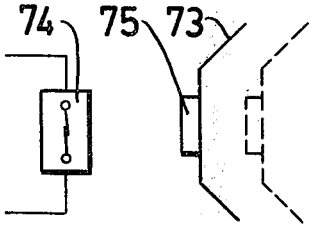
Figure 7:
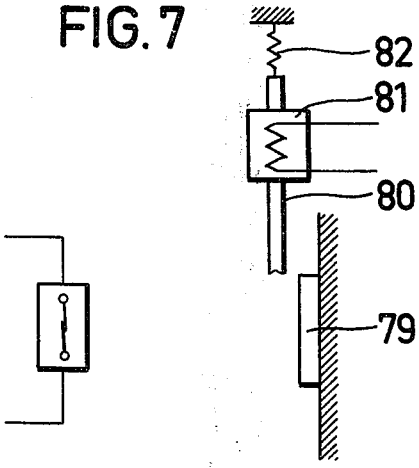
Figure 2:
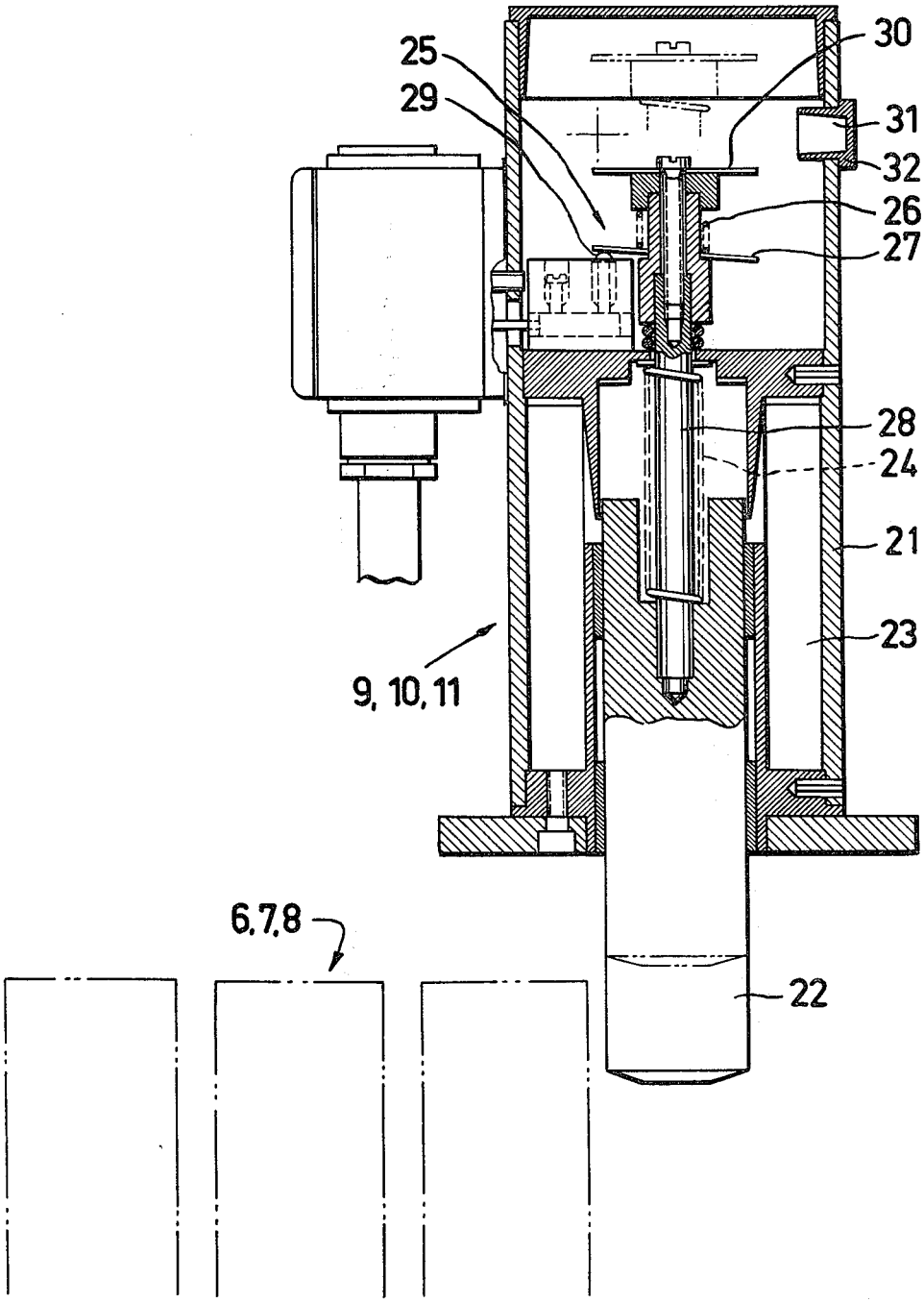
Figure 3:
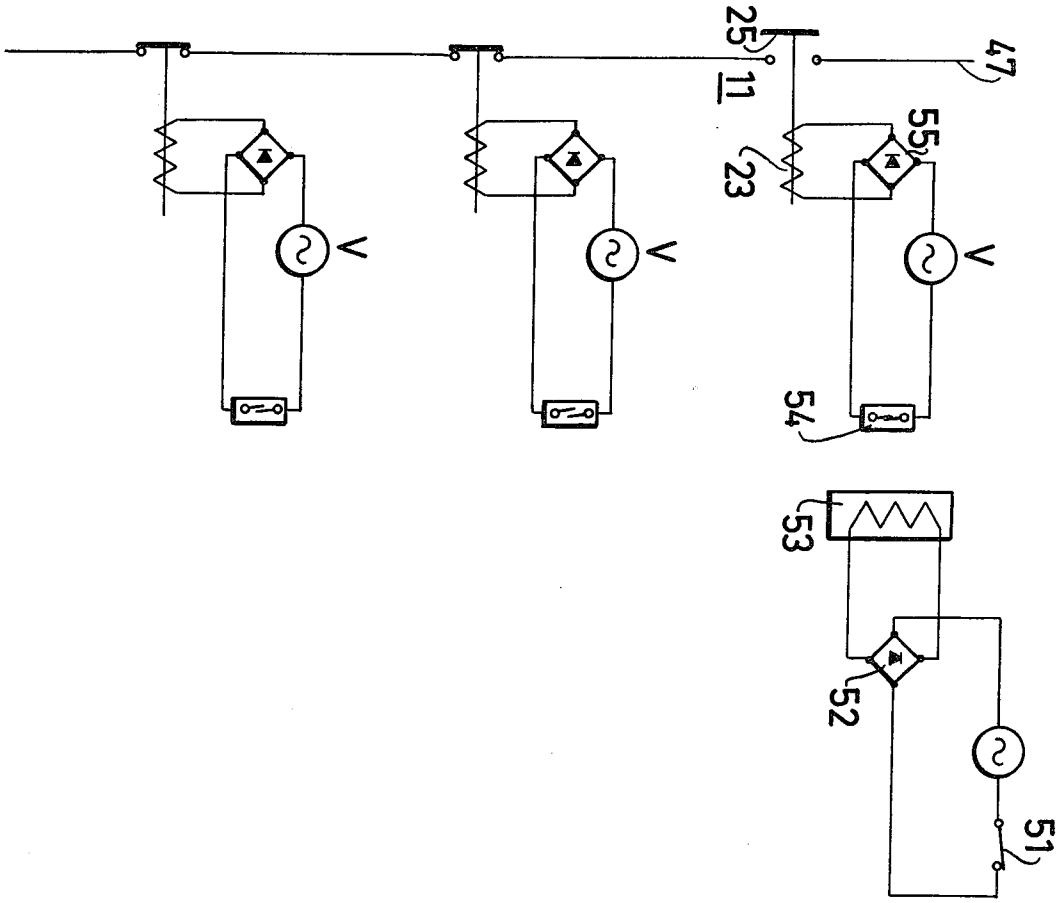
Figure 4:
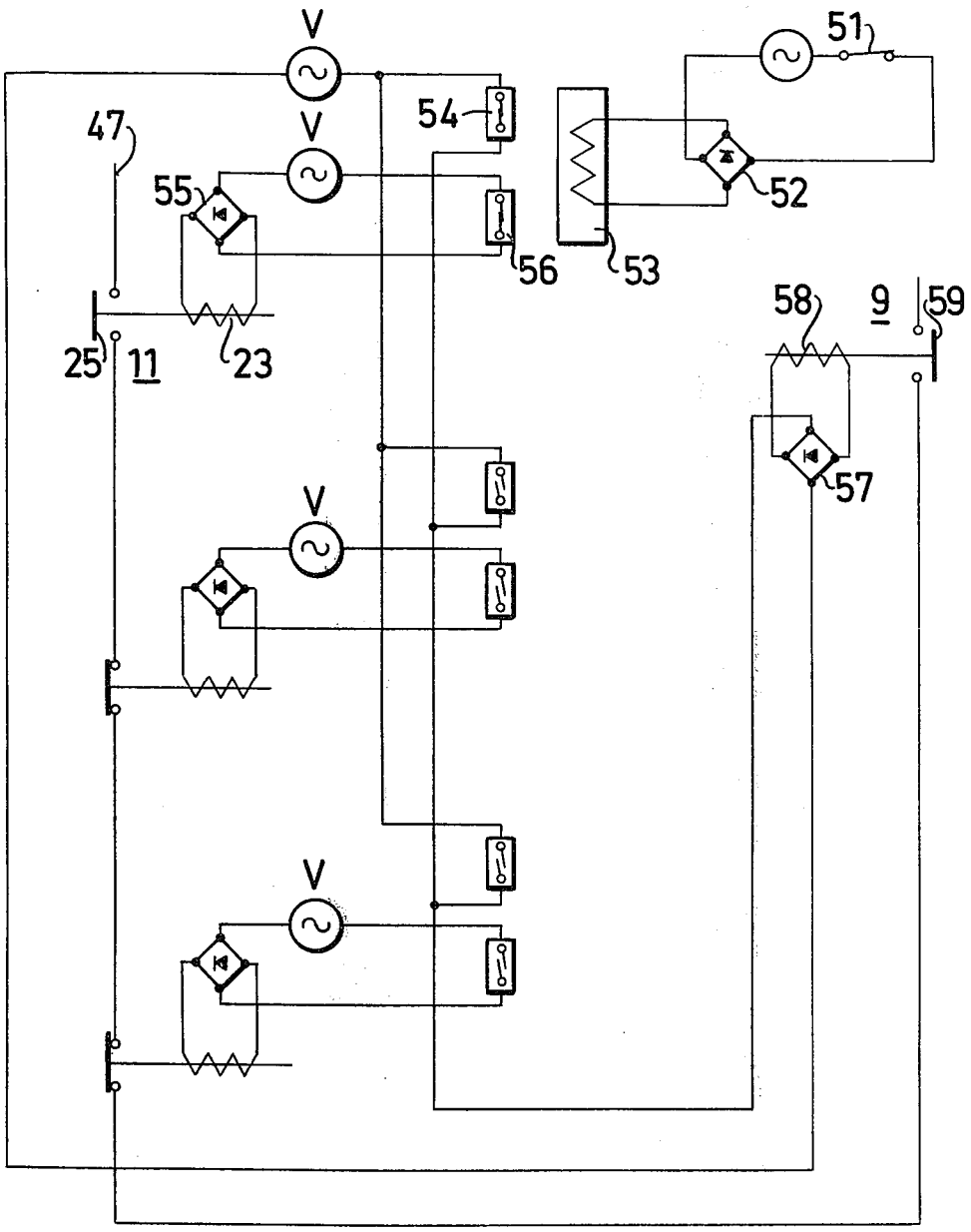

The invention is described below more in detail with reference to the enclosed drawings, wherein FIG. 1 shows an elevator with two holding floors and with a door locking means according to the invention, FIG. 2 shows a section through a door locking means, FIG. 3 shows a circuit diagram of the device of the invention for an elevator without cage door or cage gate and with a plurality of locking activators and a lock actuator device, which are not in mechanical contact with each other, FIG. 4 shows a circuit diagram of an embodiment of the invention for an elevator with a cage door or cage gate and with no mechanical cooperation between the locking activators and the lock actuator means, and FIGS. 5, 6 and 7 show different designs of locking actuators between elevator cage and hoist shaft.

With reference to FIG. 1 a movable elevator cage 1 is guided along a mast 2 and is driven by a wire 3 or by another suitable driving means such as a driven gear arranged in the elevator cage and engaging a rack arranged along the mast.

Along the travel path of the elevator cage 1 there is a plurality of holding floors, the number of which is two in the example, i.e., a lower holding floor 4 and an upper holding floor 5. Sliding doors 6, 7 and 8, respectively, which can be locked in their closed position by the locking means 9, 10 and 11, respectively, are arranged on the elevator cage 1 as well as at holding floors. The locking means are operated electrically by door locking activators 12 and 13 arranged at the relative holding floor, which locking activators are in turn operated by a lock actuator means 14 carried by the elevator cage 1, which means has been given the form of a locking path member in this Figure. As will be explained more in detail in the following, the lock actuator means 14 functions to render the cage gate 6 as well as holding floor gate 7 or 8 openable when the elevator cage is at the relative holding floor.

A special embodiment of the locking means 9, 10 and 11, all of which are preferably alike, is shown in detail in FIG. 2. Element 21 is a housing, in which a locking bolt 22 is displaceably mounted, which bolt 22 is also the armature of a magnetic coil 23. A compression spring 24 tends to push the bolt 22 out of the housing 21 to a latching position adjacent the related sliding door 6, 7 or 8. Upon connection of electric current to the coil 23, the coil will draw the bolt 22 upwardly against the action of the spring 24 and release the sliding door, which will then be free to be pushed to the right, as is seen in FIG. 2, and, as shown in broken line in FIG. 2, the bolt is thereafter retained in its unlocked position by engagement of the free end of the bolt with the upper edge of the door when the door is at least partially open. The compression spring 24 is preferably made so strong that it overcomes the dead weight of the bolt 22, and therefore the locking means can be mounted in all positions (also with the armature turned upwardly).

When the elevator cage reaches a holding floor and slows down there to be stopped, the coils 23 of the locking means of the gate of the holding floor as well as of the gate of the elevator cage will thus be fed with current from the relative locking activator 12 or 13 and be magnetized in this way and draw the bolt 22 out of locking position. In order to make sure that the bolt 22 has returned completely (as the door 6, 7 or 8 can be incompletely closed, the bolt 22 being prevented by the laths of the sliding door from being completely pushed out) to its locking position after breaking the magnetizing current to the coil 23, when the elevator is again to be moved, the locking means is provided with a security contact 25 closing a security or stop circuit, when the bolt 22 is completely brought back to locking position. This security contact 25 includes a washer 27 loaded by a spring 26 and consists of electrically conductive material, which washer is mounted around the upper end of a rod 28 connected with and projecting from the bolt 22, which rod 28 has a coating of electrically non-conductive material along a portion thereof at least as long as the stroke of the bolt. When the bolt 22 enters its locking position, i.e., a position completely pushed down, the washer 27 will shortcircuit two or more contact elements 29 arranged around the rod 28, said security or stopping circuit thereby being activated. By this embodiment it is ensured that the stop circuit cannot be closed with absolute security if the bolt is not in locking position. The locking means is moreover provided with means for making possible unlocking of the bolt 22, in an emergency situation, when there is no magnetizing current for the coil 23. These emergency opening means include a washer 30 arranged at the upper end of the rod 28, which washer can be lifted together with the rod 28 and the bolt 22 by means of a suitable tool being inserted into an aperture 31 in the housing after removing a plug 32.

Of course many other types of locking means are possible; what is essential for the locking means used with the device of the invention is only that there be an electrically conductive element accompanying the motion of the bolt, which element closes an electric circuit, when it gets into intimate contact with at least two conductive contact pins at the locking end position of the bolt. These contact pins must be located relatively far from each other to satisfy the security rules in force as to flash-over between the pins. The electrically conductive component can assume the form of a washer, a wire adapted to bridge the pins, or the like. The stroke of the bolt is of eourse also adapted so that with absolute certainty no flash-over can take place via the electrically conductive element, when the bolt is in unlocked position.

The operation of the locking means can be effected by letting the relative locking activators have the form of switches, which are operated mechanically by a movable lock path member of conventional type.

The locking path member and the locking activators are placed where it is most simple to achieve the setting between them, e.g., near the guides.

The use of a movable locking path member actuating a contact means has however certain disadvantages even if the location of the door locking activator here does not need to be dependent on the location of the lock itself. The number of movable parts is great, which considerably limits the use of the system with outdoor elevators, especially where temperatures below 0° C occur. For elevators in dips the constructive embodiment is, as a rule, so complicated that the system is not used at all. These disadvantages give rise to several shut-downs.

Therefore an embodiment of the invention has been produced that has none of these disadvantages and whose outer movable parts have been limited to one part, i.e., the bolt. This system is further built so that no mechanical contact between details arranged on a cage and details arranged at a holding floor (shaft door locks) exists. Moreover, the construction is such that the built-in shaft door locks do not need to correspond to details mounted on the cage.

According to this embodiment the lock actuator means arranged on the cage consists of a magnet operative to produce an electrically controlled magnetic field achieving the desired functions via magnetic switches arranged at the holding floors, which switches respond to a magnetic influence to close the circuit to the electromechanical door lock, to which the relative switch is connected. The magnetic switches are always open, when they are not in a magnetic field. The position of the magnet is not predetermined by the location of the doors, and therefore its built-in position is preferably selected in the vicinity of the guides, it being possible to eliminate completely the influence of the mechanical tolerances.

In FIG. 3 a circuit diagram of this embodiment of elevators without cage door or cage gate is shown. The circuit of FIG. 3 includes a contact 51, an A.C. voltage supply source, a rectifier means 52 and an electromagnet 53, and this entire circuit is situated on the elevator cage. Three further circuits, each including a magnetic field responsive switch 54, an A.C. voltage supply source V, a rectifier bridge 55, and a locking device 11 (23, 25) of the type shown in FIG. 2, are situated respectively at the different holding floors. Each circuit 54, 55, 22, 23 operates to unlock the elevator door at the associated holding floor when the elevator cage carrying the circuit 51, 52, 53 is properly situated at said floor to place electromagnet 53 in the proximity of the switch 54, and the cage-carried switch 51 is closed. The function is as follows:

When the elevator stops at a holding floor, the contact 51 in the elevator cage is closed to connect one pole of an A.C. voltage supply source, e.g., mains voltage, to one input terminal of a rectifier means 52, e.g., of the bridge type. The other input terminal of the rectifier means is permanently connected to the other pole of the voltage supply source. Electromagnet 53, below called a locking magnet, is placed across the output of the rectifier means. This magnet is arranged to produce a strong, directed magnetic field when current passes through its current coil, and can preferably be of a type as described in the Swedish patent application 7303335-9. The control of the electromagnet 53 is made by means of the switch or contact 51. The door locking activator 54 in the elevator shaft comprises, in the example shown, a reed switch, which is closed upon closure of contact 51 and resultant actuation by the magnetic field of the locking magnet 53. The contact 51 is opened when it is desired to move the elevator to a different holding floor thereby to de-energize magnet 53 and, as a result, to open the reed switch so that the bolt in the locking means is returned to its locking position by the spring associated therewith when the associated door is completely closed. Switch means other than reed switches can be employed, e.g., magnetically operated semi-conductor elements.

In certain cases, where it is possible to consider several movable parts but where a touch free operation of the switch 54 is advantageous, one can achieve the controllable magnetic field by moving a permanent magnet towards the magnetic field controlled switch, when operation is desired. The permanent magnet can for instance be located on a movable locking path member of conventional type. It is also possible to control the magnetic field controlled switches by arranging a disc of ferromagnetic material in front of a fixed permanent magnet, when operation from the magnet is not desired, and which disc is moved aside in operation.

A series connection of a voltage supply source V lies across the door locking activator 54, which source can be the same source as the voltage supply source of the locking magnet 53, and connection of the input of a rectifier means 55 of, e.g., the bridge type. The output of the rectifier means 55 is connected to the current coil 23 of the electromechanical door lock, which is preferably of the type described in connection with FIG. 2. Upon actuation by the magnetic field of magnet 53, the switch 54 is closed and current is fed through the current coil 23 of the door lock, the door lock being released and the security contact 25 following the locking means 22 being broken. The security contact 25 is connected in the stop circuit of the elevator. Therefore the elevator cannot be started.

When the elevator starts from a holding floor the door is closed and a starting impulse is emitted. The contact 51 is opened, and the field of the locking magnet 53 no longer exists. The contact in the door locking activator 54 is opened so that the magnet 23 of the door lock loses its attractive force. The return spring locks the lock, and the built-in contact 25 is closed so that the elevator can be started.

If the door should not be completely closed the door lock cannot enter its locked position, and thus the built-in contact 25 is not closed either, resulting in that the elevator cannot be started in this case.

If the elevator should be stopped between two holding floors, the locking magnet 53 is energized as described above. However, no door locking activator is near to the locking magnet 53, and therefore all the door locks remain locked.

FIG. 4 shows the same embodiment of the invention as FIG. 3, but here enlarged to apply to elevators provided with a lockable cage door or cage gate as shaft door. In this device there is, in addition to the arrangement mentioned above, another door locking activator 54 comprising a reed switch at each floor, all these door locking activators being connected in parallel with each other and this parallel connection being connected between a series connection of a voltage supply source and the input of a rectifier means 57 of bridge type. The door locking activators are only closed under the influence of a magnetic field. The output of the rectifier means 57 is connected to the magnet coil 58 of a door lock of the cage gate or cage door of the same type as for the shaft doors. Also this door lock is provided with a security contact 59, which is connected in series with the security contacts in the locks of the shaft doors and opens the stop circuit of the elevator when being broken, so that the elevator cannot start from the holding floor when one of the security contacts of the shaft doors or of the cage door or the cage gate of the elevator is broken. This has the effect that the elevator cannot be started from a holding floor, if both the shaft door and the cage door or cage gate are not accurately closed so that the bolt has entered the locked position, as the security contacts follow the locking means.

If the elevator should stop between different holding floors the contact 51 is closed, the locking magnet is fed with current, and the aforementioned magnetic fields are produced. However, there is no door locking activator within these fields, and all the bolts remain in locked position.

It is also possible to use in the connections mentioned above a lock actuator means operative to selectively emit light which actuates a switch included in the door locking means and activated by light.

In FIGS. 5, 6 and 7 different embodiments are shown schematically which can replace the devices shown in FIGS. 3 and 4, i.e., the electromagnet 53 and the reed switches 54 and 56. FIG. 5 shows the use of a movable locking path member 63 of conventional type, which - when it is desired to open a door lock by means of a circuit of the same type as the circuit 51, 52 in FIGS. 3 and 4 - can be moved outwards towards one or several door locking activators placed in the hoist shaft and designed as switches 64. The locking path member 63 is shown with a continuous line in activated position and with a dashed line in inactivated position. FIG. 6 shows a permanent magnet 75 arranged on a locking path member 73 of the same type and with the same function as the locking path member 63 in FIG. 5, which magnet actuates a switch means 74 operated by a magnetic field, which can be a reed switch or comprise magnetically controlled semi-conductor elements. The extent of movement of the locking path member and the power of the permanent magnet are so arranged that the switch 74 is closed when the locking path member 73 has been moved outwards and is opened when the locking path member 73 is in the inactivated position indicated with a dashed line. Finally FIG. 7 shows a permanent magnet 79, which is to influence a magnetic field operated switch means. A disc 80 of ferromagnetic material is normally placed in front of the magnet 79 so that the magnetic field from the magnet is shielded by the disc. Upon closure of the circuit 51, 52 in FIGS. 3 and 4 a device 81 is activated, which moves the disc 80 aside so that the magnetic field from the permanent magnet can reach a magnetically responsive means positioned opposite to the magnet. In the case shown the spring 82 represents a compression spring, which moves the disc 80 in front of the permanent magnet 79 when there is no activation of the device 81.

Many different modifications are possible within the scope of the invention.

I claim:

1. In an elevator having a cage adapted to be moved by electrically operable drive means between a plurality of holding floors, each of said holding floors having a door associated with said cage, a device for mechanically locking said doors and for selectively unlocking the door associated with said cage at a holding floor where said cage is to be stopped, said mechanical locking device at each of said floors comprising a movable locking bolt which includes magnetic material, said bolt being positioned adjacent the door on said floor, spring means engaging said bolt for urging said bolt toward a locking position relative to said door and for normally holding said bolt in its said locking position, a coil surrounding said bolt and operable when energized to move said bolt to a nonlocking position against the force of said spring means, said bolt being retained in its nonlocking position against the force of said spring means by engagement of the free end of said bolt with an edge of said door when said door is at least partially open, circuit means at each of said holding floors for selectively energizing said coil at said floor, said circuit means including a locking activator located at a fixed position at an associated one of said plurality of holding floors for controlling the energization of the coil of the locking device at said floor, the locking activator at each of said floors comprising an energization source connected to said coil via a magnetic field responsive switch which is normally open and which is operable to close when subjected to an external magnetic field thereby to operatively connect said energization source to said coil, a lock actuator carried by said elevator cage, said lock actuator comprising normally inoperative magnet means carried by said elevator cage and a control switch on said elevator cage arranged to be selectively closed to cause said magnet means to emit a sufficiently strong magnetic field, at a distance transverse to the path of travel of said elevator cage and in a plane passing through the magnetic field responsive switch when said cage is at a holding floor where said cage is to be stopped, to close the magnetic field responsive switch in the locking activator at said floor thereby to energize the coil in the locking device at said floor to move the locking bolt at said floor to its nonlocking position, each of said locking devices also including an auxiliary electrical locking device comprising further electrical switch means disposed adjacent to its said locking bolt, said further switch means including a switching element connected to and movable with said locking bolt whereby the operating state of said further switch means is responsive to the position of its associated movable locking bolt, said locking bolt being operative to move said switching element to a position wherein said further switch means is open when said locking bolt is in its nonlocking position and to move said switching element to a different position thereby to close said further switch means when said locking bolt is in its locking position, an electrical circuit including each of said further switch means at said plurality of holding floors for controlling the energization of said electrically operative elevator drive means to prevent energization of said drive means when at least one of said bolts is in its nonlocking position and the associated further switch means is accordingly open, and means for selectively opening said cage-carried control switch to terminate the emission of said magnetic field, when it is desired to move said cage away from said holding floor, thereby to de-energize the coil of the locking device at said floor to permit said spring means to return said bolt to its locking position and simultaneously to close said further switch means when the associated door is fully closed.

2. The combination of claim 1 wherein said magnet means comprises a normally deenergized electromagnet, said control switch being operative, when closed, to energize said electromagnet.

3. The combination of claim 1 wherein said magnet means is mounted for movement of said cage in a direction transverse to the path of travel of said cage, said control switch being operative, when closed, to move said magnet toward the locking device at a holding floor where said cage is to be stopped.

4. The combination of claim 3 wherein said magnet means comprises a permanent magnet.

5. The combination of claim 1 wherein said magnet means is mounted at a fixed position on said cage, and a ferromagnetic member mounted for movement adjacent said magnet means in a plane parallel to the path of travel of said cage in the region between said magnet means and said locking devices, said control switch being operative, when closed, to vary the position of said ferromagnetic member relative to said magnet means.

6. The combination of claim 1 wherein each of said magnetic field responsive switches comprises a normally open reed switch operative to be closed in response to said emitted magnetic field.

7. The combination of claim 1 wherein said cage also includes a door, a further locking device carried by said cage for mechanically locking said cage door and for selectively unlocking said cage door when said cage is at a floor where it is to be stopped, said further locking device being structurally and operationally similar to the locking devices at said holding floors and including a further locking bolt arranged to be moved between locking and nonlocking positions relative to said cage door by selective energization of an associated coil, said lock actuator on said cage also being operative to selectively energize the coil in said cage-carried locking device when said cage is at a floor where it is to be stopped.

* * * * *